US011390109B2

(12) United States Patent
Kageyama et al.

(10) Patent No.: US 11,390,109 B2
(45) Date of Patent: Jul. 19, 2022

(54) MECHANICAL PENCIL

(71) Applicant: KOTOBUKI & CO., LTD., Kawagoe (JP)

(72) Inventors: Hidehei Kageyama, Kawagoe (JP); Takeshi Wakayama, Kawagoe (JP)

(73) Assignee: KOTOBUKI & CO., LTD., Kawagoe (JP)

( * ) Notice: Subject to any disclaimer, the term of this patent is extended or adjusted under 35 U.S.C. 154(b) by 14 days.

(21) Appl. No.: 16/970,910

(22) PCT Filed: Mar. 4, 2019

(86) PCT No.: PCT/JP2019/008269

§ 371 (c)(1),
(2) Date: Aug. 18, 2020

(87) PCT Pub. No.: WO2019/168194

PCT Pub. Date: Sep. 6, 2019

(65) Prior Publication Data

US 2020/0391539 A1 Dec. 17, 2020

(30) Foreign Application Priority Data

Mar. 2, 2018 (JP) ..... JP2018-037032

(51) Int. Cl.
*B43K 21/16* (2006.01)
*B43K 21/22* (2006.01)

(52) U.S. Cl.
CPC ..... *B43K 21/16* (2013.01); *B43K 21/22* (2013.01)

(58) Field of Classification Search
CPC ..... B43K 21/16; B43K 21/22
See application file for complete search history.

(56) References Cited

U.S. PATENT DOCUMENTS 4,275,971 A * 6/1981 Katz ..... B43K 21/027 401/80
4,620,811 A * 11/1986 Kageyama ..... B43K 21/20 401/65
6,234,697 B1 * 5/2001 Kanari ..... B43K 21/22 401/92
6,382,859 B2 5/2002 Noguchi et al.
(Continued)

FOREIGN PATENT DOCUMENTS

FR 1.090.004 A 3/1955
JP H07-290880 A 11/1995
(Continued)

OTHER PUBLICATIONS

International Search Report (ISR) (PCT Form PCT/ISA/210), in PCT/JP2019/008269, dated Apr. 9, 2019.

*Primary Examiner* — J C Jacyna
(74) *Attorney, Agent, or Firm* — McGinn I.P. Law Group, PLLC.

(57) ABSTRACT

A mechanical pencil includes a writing lead, a chuck unit for chucking the writing lead, and a cushion spring configured to elastically support the chuck unit in such a manner that the chuck unit is retractable with a writing pressure. An output of the cushion spring, in response to a cushion stroke, is non-linear, and a slope of a spring constant, in a region where the cushion stroke is relatively small, is smaller than a slope of a spring constant in a region where the cushion stroke is relatively large.

10 Claims, 9 Drawing Sheets

(56) References Cited

U.S. PATENT DOCUMENTS

| | | | | |
|---|---|---|---|---|
| 2001/0009628 | A1 | 7/2001 | Noguchi et al. | |
| 2002/0154934 | A1* | 10/2002 | Maruyama | B43K 21/16 401/92 |
| 2016/0039243 | A1* | 2/2016 | Aizawa | B43K 21/22 401/55 |
| 2018/0186173 | A1* | 7/2018 | Kajiwara | B43K 21/22 |
| 2019/0344603 | A1* | 11/2019 | Keda | B43K 21/16 |
| 2019/0375230 | A1* | 12/2019 | Kageyama | B43K 21/20 |

FOREIGN PATENT DOCUMENTS

| | | | |
|---|---|---|---|
| JP | 10-091314 | * | 4/1998 |
| JP | 2001-270283 | A | 10/2001 |
| JP | 2016-036950 | A | 3/2016 |
| WO | WO 2018/190311 | A1 | 10/2018 |

* cited by examiner

MECHANICAL PENCIL

FIELD

This disclosure relates to a mechanical pencil that includes a chuck for chucking a writing lead and that is capable of feeding out the writing lead by a click operation.

BACKGROUND

Conventionally, there is known a mechanical pencil including a writing lead tank slidably provided inside a barrel, a chuck fixed to a tip part of the writing lead tank, a chuck ring loosely fitted to the chuck, a sleeve provided between the barrel and the chuck, an elastic body which abuts with the sleeve and which is mounted so that a part thereof is attached with pressure to the writing lead tank, and operating means which compresses the elastic body and makes the writing lead tank movable in an axial direction (for example, refer to PTL 1).

CITATION LIST

Patent Literature

PTL 1: Japanese Patent Application Laid-open No. H 07-290880 (for example, refer to paragraphs 0006, 0007, and 0017)

SUMMARY

Disclosure

According to the mechanical pencil disclosed in PTL 1, a stroke for pushing out a slider can be sufficiently obtained with a simple structure which integrates a chuck fastening spring with a cushion spring. In addition, excessive writing pressure can be absorbed by the cushion spring, preventing breakage of the writing lead. However, it has conventionally been desired to provide a mechanical pencil that has a cushion spring that not only can prevent breakage of the writing lead thereof but also provides more excellent writing feel than conventional one, such as a softer writing touch.

An exemplary object of this invention is to provide a mechanical pencil that has a cushion spring that provides more excellent writing feel than the prior art.

In one aspect of the present invention, a mechanical pencil includes a writing lead, a chuck unit for chucking the writing lead, and a cushion spring configured to elastically support the chuck unit so that the chuck unit being retractable with a writing pressure, wherein an output in response to a cushion stroke of the cushion spring is non-linear, and a slope of a spring constant in a region where the cushion stroke is relatively small is smaller than a slope of a spring constant in a region where the cushion stroke is relatively large.

In a plurality of exemplary aspects according to this invention, a mechanical pencil that has a cushion spring that provides more excellent writing feel than the prior art can be provided.

DESCRIPTION OF EMBODIMENTS

Figure 1:
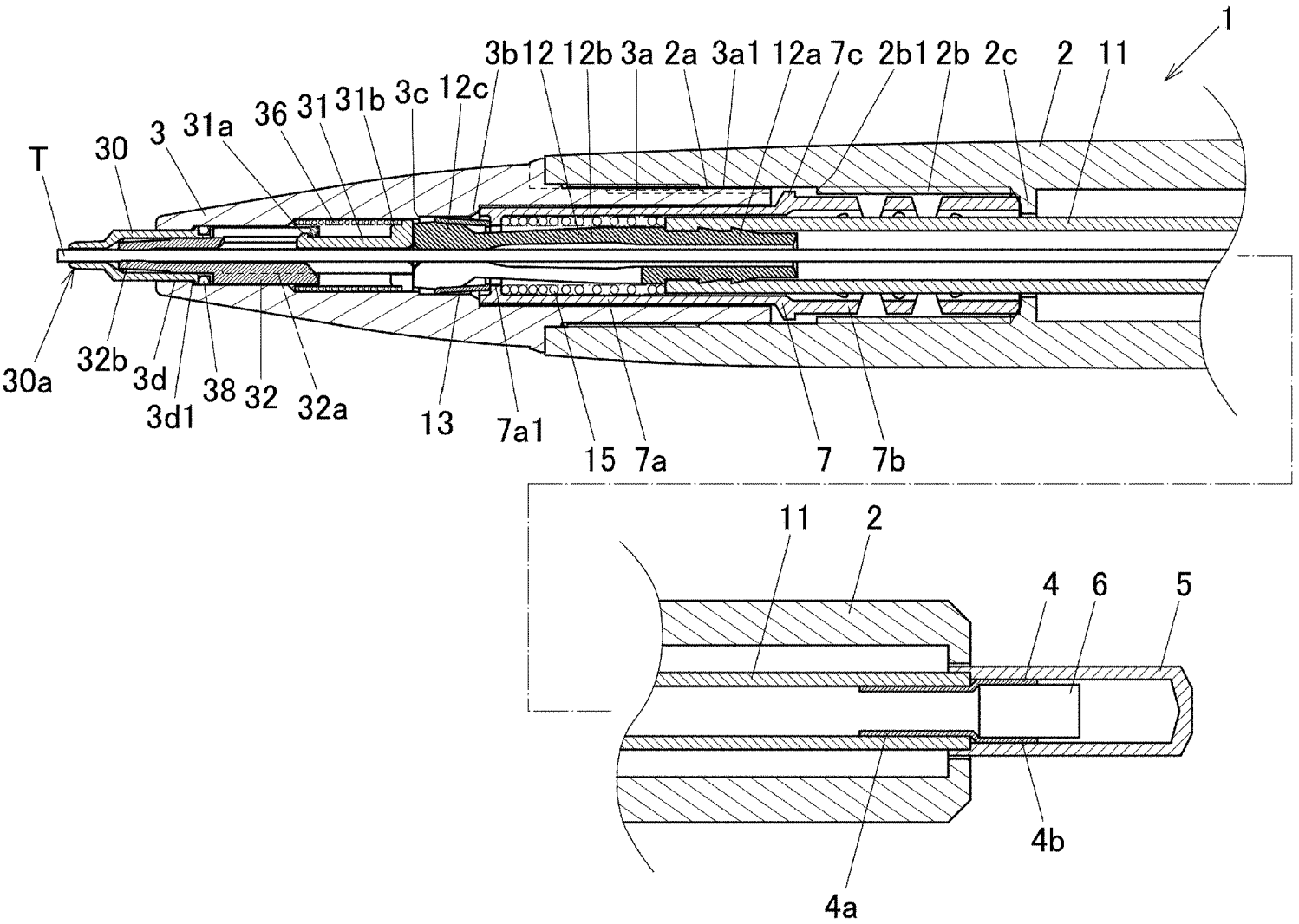
FIG. 1 is a partial sectional view illustrating a forward-side portion and a rearward-side portion while omitting an intermediate portion of a mechanical pencil according to an embodiment.

Hereinafter, embodiments will be described with reference to the drawings. A mechanical pencil 1 according to the present embodiment illustrated in FIG. 1 is a rear end click-type mechanical pencil in which a writing lead T is fed out and protrudes from a tip of a tip fitting 3 by a click operation on a click button 5. Moreover, in the following description, a side on which the tip fitting 3 of the mechanical pencil 1 is arranged will be referred to as front and a side on which the click button 5 is arranged will be referred to as rear in a direction of a central axis (i.e., an axial direction) which extends in a longitudinal direction of the mechanical pencil 1.

The mechanical pencil 1 includes a barrel body 2 with an approximately cylindrical shape and the tip fitting 3 having an approximately conical front part and an approximately cylindrical rear part. A barrel is formed so as to include the barrel main body 2 and the tip fitting 3. The tip fitting 3 is arranged to the front of the barrel body 2. A cylindrical part 3*a* having an outer diameter smaller than a rear end diameter of a front part of the tip fitting 3 is formed in a rear part of the tip fitting 3. The tip fitting 3 is fixed to the barrel body 2 by screwing an internal screw part 2*a* formed on an inner circumferential surface of a front end part of the barrel body 2 and an external screw part 3*a*1 formed on an outer circumferential surface of the cylindrical part 3*a* in the rear part of the tip fitting 3.

The click button 5 formed in a bottomed cylindrical shape is attachably and detachably mounted to a rear end of a writing lead tube 11 arranged inside the barrel body 2. An inner circumferential surface of a front end opening of the click button 5 is attachably and detachably fitted to an outer circumferential surface of the rear end of the writing lead tube 11. An outer circumferential surface of a front part of an eraser ferrule 4, formed in an approximately cylindrical shape, is attachably and detachably fitted and assembled to an inner circumferential surface of the rear end of the writing lead tube 11. The eraser ferrule 4 has a forward-side small diameter part 4*a* and a rearward-side large diameter part 4*b*. An outer circumferential surface of an eraser 6 is attachably and detachably fitted and assembled to an inner circumferential surface of the large diameter part 4*b* of the eraser ferrule 4.

The writing lead tube 11, internally housing the writing lead T, is formed in an approximately cylindrical shape and arranged inside the barrel body 2. A chuck 12 is assembled to a front part of the writing lead tube 11. The chuck 12 is formed so as to be capable of chucking the writing lead T by chucking/clamping in a radial direction when each chuck piece formed by dividing a tip of the chuck 12 into three parts in a circumferential direction elastically deforms toward a central axis. The chuck 12 has a rear end base part 12*a* fixed by being inserted into the writing lead tube 11, a beam-like part 12*b* extending forward from the base part 12*a*, and a bulging part 12*c* formed at a front end of the beam-like part 12*b*. A chuck ring 13 is fittably and detachably mounted to an outer circumference of the bulging part 12*c*. An approximately cylindrical cushion member 7 is arranged on the rear side of the chuck ring 13 so as to cover the range from the beam-like part 12*b* of the chuck 12 to the front part of the writing lead tube 11, from an outer diameter direction.

Figure 2:
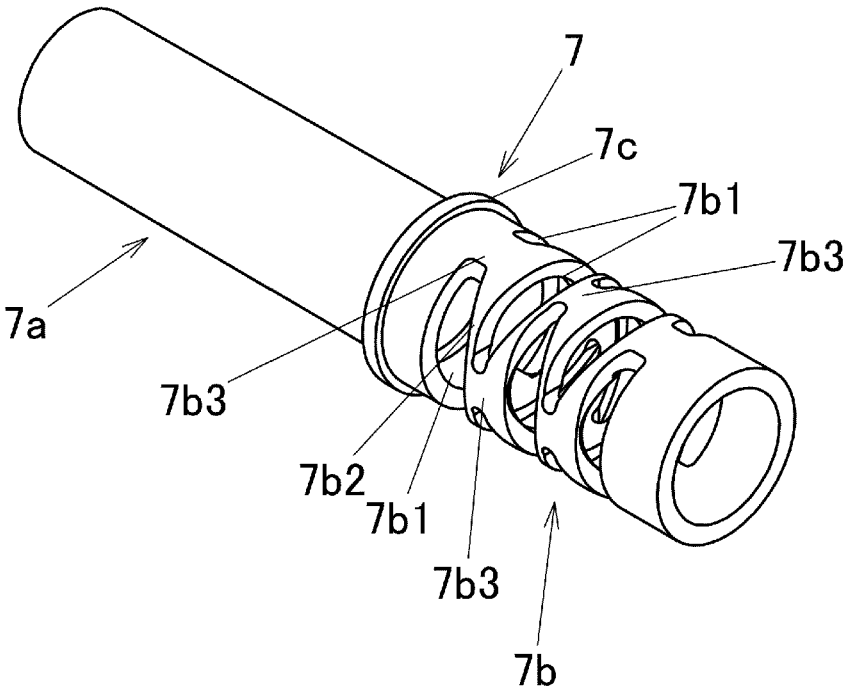
FIG. 2 is a perspective view illustrating a sleeve having a cushion spring of the mechanical pencil according to the embodiment.

As illustrated in FIGS. 1 and 2, a cylindrical sleeve part 7*a* that is inserted from the cylindrical part 3*a* of the tip fitting 3 into the tip fitting 3 along an inner circumferential surface of the tip fitting 3 is formed in a front part of the cushion member 7. An approximately cylindrical spring part 7*b*, arranged behind the cylindrical part 3*a* of the tip fitting 3 and having a diameter larger than that of the sleeve part 7*a*, is formed in the rear part of the cushion member 7. A flange part 7*c*, arranged behind the cylindrical part 3*a* of the tip fitting 3 and having a diameter larger than that of the spring part 7*b*, is formed in the connecting portion between the sleeve part 7*a* and the spring part 7*b*. An annular wall 7*a*1 is formed so as to protrude inward in the radial direction on an inner circumferential surface of a front end part of the sleeve part 7*a*.

The cushion member 7 is integrally formed of a resin. As illustrated in FIG. 2, the spring part 7*b* of the cushion member 7 is formed by forming a pair of elongated holes 7*b*1 so as face each other with an axis therebetween, the elongated holes 7*b*1 opening along a circumferential direction of the cylindrical outer wall, and by arranging the pairs of plurality of elongated holes 7*b*1 along the axial direction. The pairs of elongated holes 7*b*1, adjacent to each other along the axial direction, are arranged in the circumferential direction so as to be in a relative positional relationship in which the longitudinal holes 7*b*1 rotate 90 degrees about the axis. In this arrangement, the length of the spring part 7*b* in the axial direction can be reduced. In the present embodiment, five pairs of elongated holes 7*b*1 are formed along the axial direction. An elastic beam-like part 7*b*2 is formed between the pairs of elongated holes 7*b*1 adjacent to each other in the axial direction. Furthermore, inter-hole struts (i.e., axially extending parts) 7*b*3 are formed between the pairs of elongated holes 7*b*1 arranged in the circumferential direction. The elastic beam-like part 7*b*2 is formed in such a manner that the thickness thereof in the axial direction gradually decreases from the front-side inter-hole strut 7*b*3 toward the rear-side inter-hole strut 7*b*3 that is adjacent thereto in the axial direction. When applied a force in the axial direction, the spring part 7*b* generates an elastic force as the elastic beam-like part 7*b*2 bends in a direction in which the opening of each elongated hole 7*b*1 shrinks.

Figure 3:
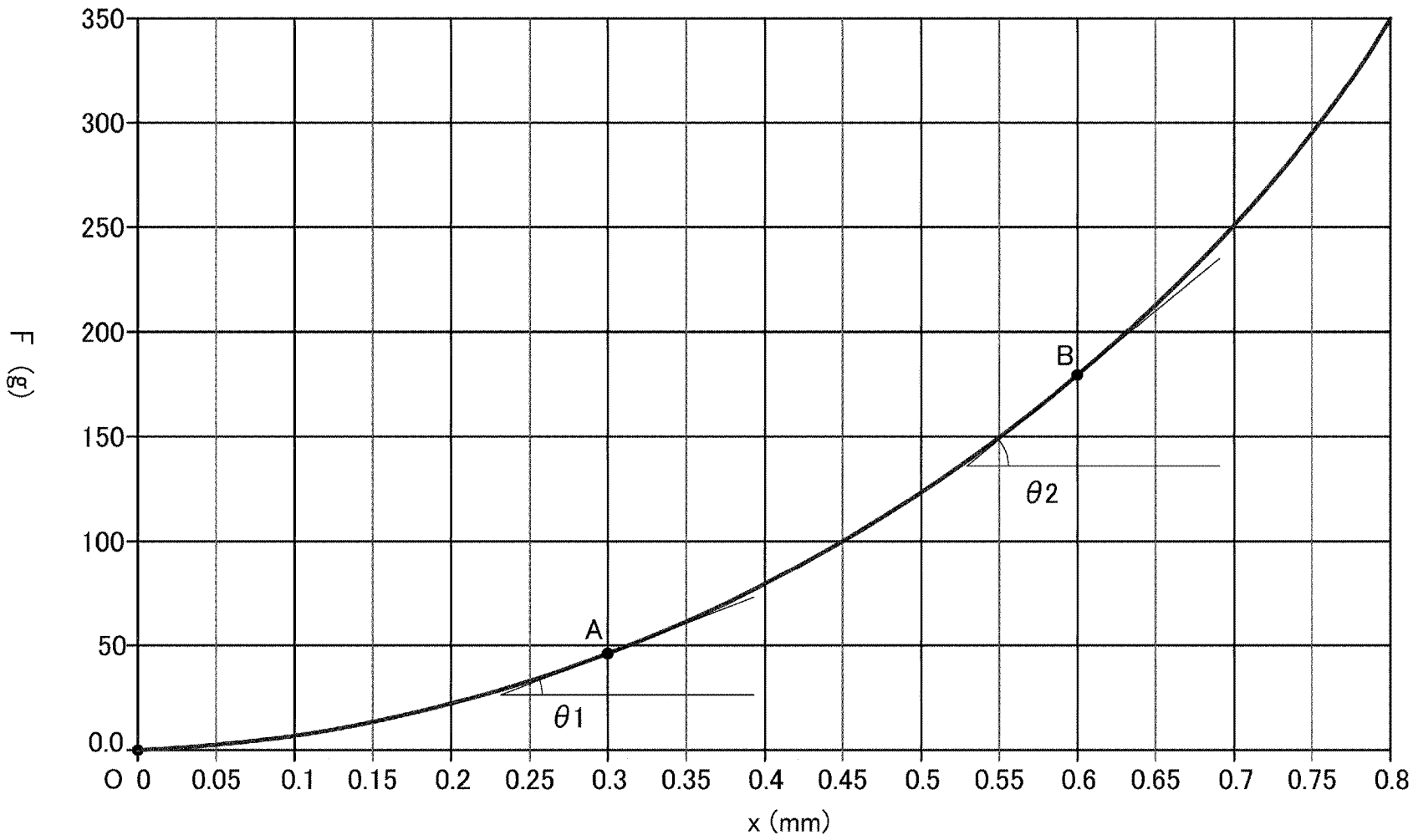
FIG. 3 is a diagram illustrating a relationship between a cushion stroke and a writing pressure in the cushion spring of the mechanical pencil according to an embodiment.

As illustrated in FIG. 3, the spring part 7*b* of the cushion member 7 is configured in such a manner that an output in response to a stroke (i.e., a cushion stroke) of the spring part 7*b* is non-linear. Details will be described below.

Returning to FIG. 1, an outer circumference of the sleeve part 7*a* of the cushion member 7 is guided in proximity to an inner circumferential surface of the cylindrical part 3*a* of the tip fitting 3. The inner circumferential surface of the sleeve part 7*a* is guided in proximity to the outer circumferential surface of the writing lead tube 11. A plurality of ribs 2*b*, extending in the axial direction, are formed on the inner circumferential surface of the barrel body 2 corresponding to the outer circumference of the spring part 7*b* of the cushion member 7. Each of the plurality of ribs 2*b* forms a stepped part 2*b*1 between a front end of each rib 2*b* and the inner circumferential surface of the barrel body 2. The stepped part 2*b*1 is formed so as to face a rear surface of the flange part 7*c* of the cushion member 7. A protruding part 2*c* that annularly protrudes inward in the radial direction is formed on the inner circumferential surface of the barrel body 2 at the rear of the spring part 7*b* of the cushion member 7. A rear end surface of the spring part 7*b* of the cushion member 7 abuts with a front surface of the protruding part 2*c*.

A chuck spring 15, which includes a coil spring, is assembled between the outer circumferential surface of the beam-like part 12*b* of the chuck 12 and the inner circumferential surface of the sleeve part 7*a* of the cushion member 7. A front end of the chuck spring 15 abuts with a rear surface of the annular wall 7*a*1 of the sleeve part 7*a* and a rear end of the chuck spring 15 abuts with a front end surface of the writing lead tube 11. The chuck spring 15 is assembled in a state of being compressed in the axial direction between the cushion member 7 and the writing lead tube 11. Since the writing lead tube 11 and the chuck 12 are biased rearward with respect to the sleeve part 7*a* of the cushion member 7 by a biasing force of the chuck spring 15, the chuck ring 13 fitted to the chuck 12 is also biased rearward with respect to the sleeve part 7*a*. Consequently, a rear end surface of the chuck ring 13 abuts with a front surface of the annular wall 7*a*1 of the sleeve part 7*a*.

An annular stepped part 3*b* is formed on the inner circumferential surface of the tip fitting 3 in such a manner as to face the front end surface of the sleeve part 7*a* of the cushion member 7. The front end surface of the sleeve part 7*a* of the cushion member 7 abuts with the stepped part 3*b* while being biased forward by the spring part 7*b* of the cushion member 7.

A stepped part 3*c* is formed on the inner circumferential surface of the tip fitting 3, to the front of the stepped part 3*b*, in such a manner that the front end surface of the chuck ring 13 is abuttable with the stepped part 3*c* when moving forward. When the front end surface of the chuck ring 13 abuts with the stepped part 3*c* of the tip fitting 3, the chuck ring 13 separates rearward from the chuck 12 and the writing lead T is released from the chuck of the chuck 12. A series of feed-out operations by the mechanical pencil 1 will be described below in detail.

At a position to the front in the vicinity of the front end surface of the chuck 12, a guide tube 31 is arranged so as to be movable in the axial direction. The guide tube 31 has a disk-shaped base end part 31*b*, a central hole into which the writing lead T is inserted in the axial direction, and a plurality of forward protruding parts 31*a* formed around the central hole in such a manner as to protrude forward from the base end part 31*b*. A tip of each forward protruding part 31*a* is formed in a hook shape as illustrated and, when engaged inside a slit 32*a* formed in a writing lead holder 32 to be described in detail below, the forward protruding part 31*a* is locked so as to be relatively movable in a front-rear direction with respect to the writing lead holder 32.

A stepped part is formed at an outer circumferential edge of the base end part 31*b* of the guide tube 31. In addition, a stepped part of an inner circumference of the tip fitting 3 is formed on the inner circumferential surface of the tip fitting 3 that faces the stepped part of the base end part 31*b* of the guide tube 31 in the axial direction. A return spring 36 that is a compression coil spring for biasing the guide tube 31 rearward in the axial direction with respect to the tip fitting 3 is arranged between the base end part 31*b* of the guide tube 31 and the stepped part of the inner circumference of the tip fitting 3. In a state in which the guide tube 31 is biased rearward by the return spring 36, a rear end surface of the base end part 31*b* of the guide tube 31 approaches the front end surface of the chuck 12 from the front. In addition, when the chuck 12 moves forward, a rear end surface of the guide tube 31 abuts with a tip surface of the chuck 12 from the front. In this state, the rear end surface of the guide tube 31 approaches or abuts with the tip surface of the chuck 12 from the front. Therefore, the base end part 31*b* of the guide tube 31 supports the writing lead T protruding from the tip surface of the chuck 12, in a direction perpendicular to the axial direction. Therefore, a bending moment of the writing lead T chucked by the chuck 12, which acts on a position on the tip surface of the chuck 12 in the axial direction, can be reduced, preventing writing lead breakage of the writing lead T at the position on the tip surface of the chuck 12.

At a position to the front of the guide tube 31, the writing lead holder 32 is arranged so as to be movable in the axial direction. A plurality of slits 32*a* extending in the front-rear direction are formed on the writing lead holder 32. The hook-shaped tips of the forward protruding parts 31*a* of the guide tube 31 are brought into engagement with the slits 32*a* in a slidable manner. Accordingly, the guide tube 31 is locked so as to be relatively movable in the front-rear direction with respect to the writing lead holder 32. The central hole into which the writing lead T is inserted in the axial direction is formed in the writing lead holder 32. A holding part 32*b* that sandwiches and holds the writing lead T inward in the radial direction is formed at a tip portion of the central hole of the writing lead holder 32. To the front of the writing lead holder 32 is arranged a tip tube 30 having an approximately tapered cylindrical shape which has an outer circumferential surface sliding against an inner circumferential surface of the opening part 3*d* of the tip fitting 3 and is configured so as to be movable in the axial direction while supporting the writing lead T from the outer diameter direction. A contact part 30*a* obtained when the tip tube 30 comes into contact with a paper surface (i.e., a tip outer circumference of the tip tube 30) is rounded to form a roundedly chamfered edge/corner. Therefore, even in a case where the contact part 30*a* of the tip tube 30 moves while in contact with the paper surface, writing can be performed while favorably causing the tip tube 30 to retract, without having the tip tube 30 caught on the paper surface. The writing lead holder 32 is inserted into the tip tube 30 from the rear and assembled to the tip tube 30.

A flange part is formed at a rear end of the tip tube 30. An O-ring 38 that elastically supports the tip tube 30 and the writing lead holder 32 in the direction perpendicular to the axial direction is assembled to an outer circumference of the flange part. The O-ring 38 is configured so as to impart a prescribed sliding resistance with respect to movements of the tip tube 30 and the writing lead holder 32 in the front-rear direction. In the present embodiment, the prescribed sliding resistance is configured to be a sliding resistance capable of holding the tip tube 30 and the writing lead holder 32 so that the writing lead T having been fed out can be held in the axial direction. The prescribed sliding resistance is configured to be a sliding resistance which, when a larger pressing force in the axial direction is applied to the tip tube 30 or the writing lead holder 32, allows movements of the tip tube 30 and the writing lead holder 32 so that the tip tube 30 protrudes from the tip fitting 3 or the tip tube 30 is housed inside the tip fitting 3. Forward movements of the tip tube 30 and the writing lead holder 32 are restricted as the flange part of the tip tube 30 abuts with a stepped part 3*d*1 formed on the inner circumferential surface of the opening part 3*d* of the tip fitting 3.

A chuck unit capable of chucking and feeding out the writing lead T includes the chuck 12, the chuck ring 13, the sleeve part 7*a* of the cushion member 7, and the chuck spring 15, and is housed inside the barrel. The chuck unit is elastically supported by the spring part 7*b* of the cushion member 7 (i.e., the cushion spring) so as to be retractable by a load (so-called "writing pressure") generated in the axial direction by writing.

Retracting of the chuck unit is restricted by the rear surface of the flange part 7*c* of the cushion member 7 coming into abutment with the stepped part 2*b*1 of the front end of the rib 2*b* formed on the inner circumferential surface of the barrel body 2. The space (i.e., cushion stroke) between the flange part 7*c* and the stepped part 2*b*1 of the rib 2*b* in the set state of the cushion member 7 is set within a range of a prescribed stroke length in which the spring part 7*b* is not damaged when the elongated holes 7*b*1 of the spring part 7*b* of the cushion member 7 shrink and thereby the elastic beam-like part 7*b*2 is repeatedly brought into close/solid contact with the spring part 7*b*.

Moreover, it is desired that the cushion stroke be limited within the range of the prescribed stroke length in which the writing lead T is not bent/broken by the writing pressure when the writing lead T protrudes from the tip of the tip tube 30 by the same length as the cushion stroke. For example, when the cushion stroke is set at 0.8 mm, the writing lead T protrudes by at least 0.8 mm, which is the same as the cushion stroke, from the tip of the tip tube 30 that is brought into contact with the paper surface and retracts as a result of a cushion operation, after the writing lead T is released from the writing pressure. Even if writing applies the writing pressure to the writing lead T, then bending/breaking of the writing lead T by the writing pressure can be prevented by the configuration in which the protruded writing lead T is housed substantially entirely in the tip tube 30 again due to bending of the cushion spring (e.g., the spring part 7*b*). In order to achieve this configuration, it is preferred that the cushion stroke (i.e., full stroke) falls substantially in the range of, for example, 0.8 mm±0.4 mm.

Furthermore, the cushion member 7 can be assembled so as to have an arbitrary prescribed set load in a state in which the spring part 7*b* of the cushion member 7 is compressed by the stepped part 3*b* of the inner circumferential surface of the tip fitting 3 and the protruding part 2*c* of the inner circumferential surface of the barrel body 2. Actions and effects of the spring part 7*b*, functioning as the cushion spring, are described below in detail.

In the present embodiment, the set load of the spring part 7*b* of the cushion member 7 is set to be equal to or lower than a sliding resistance obtained by an O-ring 38 of the tip tube 30 (i.e., the resistance force resulting from axial retracting of the tip tube 30). According to this configuration, the cushioning operation of the spring part 7*b* of the cushion member 7 can be executed so that the tip of the tip tube 30 easily comes into contact with the paper surface. In addition, in the present embodiment, the holding force of the writing lead holder 32 holding the writing lead T (the sliding resistance in the axial direction thereof), too, is set to be smaller than the sliding resistance caused by the O-ring 38 of the tip tube 30. According to this configuration, the cushioning operation of the spring part 7*b* can be executed so that the tip of the tip tube 30 comes into contact with the paper surface more easily. Moreover, the set load of the spring part 7*b* of the cushion member 7 in the present embodiment is set to be smaller than the holding force of the writing lead holder 32 holding the writing lead T. According to this configuration, the cushioning operation of the spring part 7*b* can be executed so that the tip of the tip tube 30 comes into contact with the paper surface more easily. With the mechanical pencil 1 of the present embodiment, writing by the writing lead T can be executed because the tip tube 30 in contact with the paper surface can further retract by the writing pressure, even when the spring part 7*b* of the cushion member 7 performs the cushioning operation so that the tip of the tip tube 30 comes into contact with the paper surface and when the writing lead T is housed in the tip tube 30.

Furthermore, in the tip tube 30 of the present embodiment, the resistance force is generated by the frictional resistance between the O-ring 38 and the inner circumferential surface of the tip fitting 3, but in another embodiment, a prescribed resistance force may be generated by a set load of any spring configured to elastically support the tip tube 30 in the axial direction.

How the writing lead T is fed out by the mechanical pencil 1 is described next. In a state in which the tip tube 30 is housed inside the tip fitting 3, the base end part 31*b* of the guide tube 31 and the rear end of the writing lead holder 32 come into abutment with each other. From this state, by performing the click operation in which the click button 5 is pressed, the guide tube 31 moves forward along with the chuck 12 moving forward, and thereby the writing lead holder 32 and the tip tube 30 protrude from the tip fitting 3, obtaining the state illustrated in FIG. 1. The click operation in the state illustrated in FIG. 1 is described hereinafter.

As a result of the click operation of clicking the click button 5, the writing lead tube 11, the chuck 12 to which the chuck ring 13 is fitted, and the writing lead T chucked by the chuck 12 move forward against a biasing force of the chuck spring 15. The guide tube 31 abutting with the chuck 12 having moved forward is also pressed forward and moves forward against a biasing force of the return spring 36. As a result of the guide tube 31 having moved forward, a front surface of the base end part 31*b* of the guide tube 31 comes into abutment with the rear end of the writing lead holder 32. In this manner, the writing lead holder 32 that is pressed by the base end part 31*b* of the guide tube 31 moves forward until the flange part of the tip tube 30 comes into abutment with the stepped part 3*d*1 on the inner circumferential surface of the tip fitting 3 along with the tip tube 30 assembled to the writing lead holder 32, and the writing lead holder 32 then protrudes forward from the tip fitting 3. Once the chuck 12 and the chuck ring 13 have moved by a prescribed interval, the front end surface of the chuck ring 13 abuts with the abutting surface of the stepped part 3*c* formed on the inner circumferential surface of the tip fitting 3, and the chuck ring 13 disengages rearward from the bulging part 12*c* of the chuck 12. Once the chuck ring 13 disengages, each chuck piece of the chuck 12 opens outward in the radial direction due to elasticity and the writing lead T is released. The writing lead T is fed out by a prescribed feed-out amount per click operation in the mechanical pencil 1 and is then released, and in this position the writing lead T is sandwiched by the writing lead holder 32. When the click button 5 is released from being clicked and the chuck unit is released from the click operation, the chuck 12 and the chuck ring 13 retract, leaving the writing lead T at the position where the writing lead T was fed out and released, and once again chuck the writing lead T at a position farther rear than the position obtained prior to the click operation. Furthermore, when the chuck unit is released from the click operation and the chuck 12 and the chuck ring 13 retract, the guide tube 31 is biased by the return spring 36 and retracts to the position where the rear end of the guide tube 31 approaches or abuts with the chuck 12.

The mechanical pencil 1 is used when writing in the state in which a prescribed amount of the writing lead T protrudes from the tip tube 30 or in the state in which the writing lead T is housed in the tip tube 30. The writing pressure during writing is applied to the writing lead T, the chuck 12 and the chuck ring 13 that chuck the writing lead T, and the sleeve part 7*a* of the cushion member 7. The spring part 7*b* functioning as the cushion spring elastically deforms in accordance with this writing pressure, whereby the cushioning operation occurs in which the writing lead T, the chuck 12, the chuck ring 13, and the sleeve part 7*a* of the cushion member 7 retract rearward with respect to the barrel body 2. In a case where the tip of the tip tube 30 comes into contact with the paper surface, the tip tube 30 retracts rearward in the axial direction by the writing pressure, against the sliding resistance with the tip fitting 3.

The diagram of FIG. 3 illustrating the relationship between the cushion stroke and the writing pressure is used to specifically describe embodiments. In FIG. 3, in a state in which the cushion member 7 is assembled in the barrel at a prescribed set load, a cushion stroke x (mm) is defined as 0. In the present embodiment, the prescribed set load mentioned above is substantially 0. At point A on the diagram, since the elasticity of the cushion member 7 is configured in such a manner that the writing pressure is approximately 48 g and the cushion stroke is approximately 0.3 mm, the chuck unit retracts approximately 0.3 mm when the writing pressure is approximately 48 g. Similarly, as indicated by point B, the elasticity of the cushion member 7 is configured so that the chuck unit retracts approximately 0.6 mm when the writing pressure is approximately 180 g. Here, the slope of the spring constant is defined as the slope of the tangent line of an arbitrary point on the relationship diagram illustrated in FIG. 3. In the present embodiment, the slope of the spring constant of the spring part 7*b* of the cushion member 7 is configured in such a manner that the slope of the spring constant in a region where the cushion stroke x (mm) is relatively small (for example, 0 to less than 0.4 mm), is smaller than the slope of the spring constant in a region where the cushion stroke x (mm) is relatively large (for example, 0.4 mm or more). Specifically, for example, the slope of the spring constant at point A is $\theta 1$, and the slope of the spring constant at point B is $\theta 2$, wherein $\theta 1<\theta 2$. Therefore, the spring part 7*b*, which is the cushion spring, can be cushion-operated to generate the prescribed cushion stroke x (mm) even when a load extremely smaller than the normal writing pressure (approximately 300 g is considered standard) is applied. On the other hand, with a load close to the normal writing pressure, a cushion stroke is less likely to occur (i.e., the writing feel is harder) compared to a region with a load smaller than the normal writing pressure. The present embodiment is configured in such a manner that the slope of the spring constant increases together with (according to) the cushion stroke. With this configuration, while the cushion operation can be caused with a relatively small writing pressure, the cushion stroke can be prevented from becoming excessively large. In this case, an excellent writing feel with a soft writing touch and a firm feel can be obtained. Another embodiment may be configured in such a manner that, for example, the slope of the spring constant monotonically increases at a constant rate as the cushion stroke increases. In this case, the output of the cushion spring at the time of a cushion stroke is performed can be easily predictable.

Figure 4A:
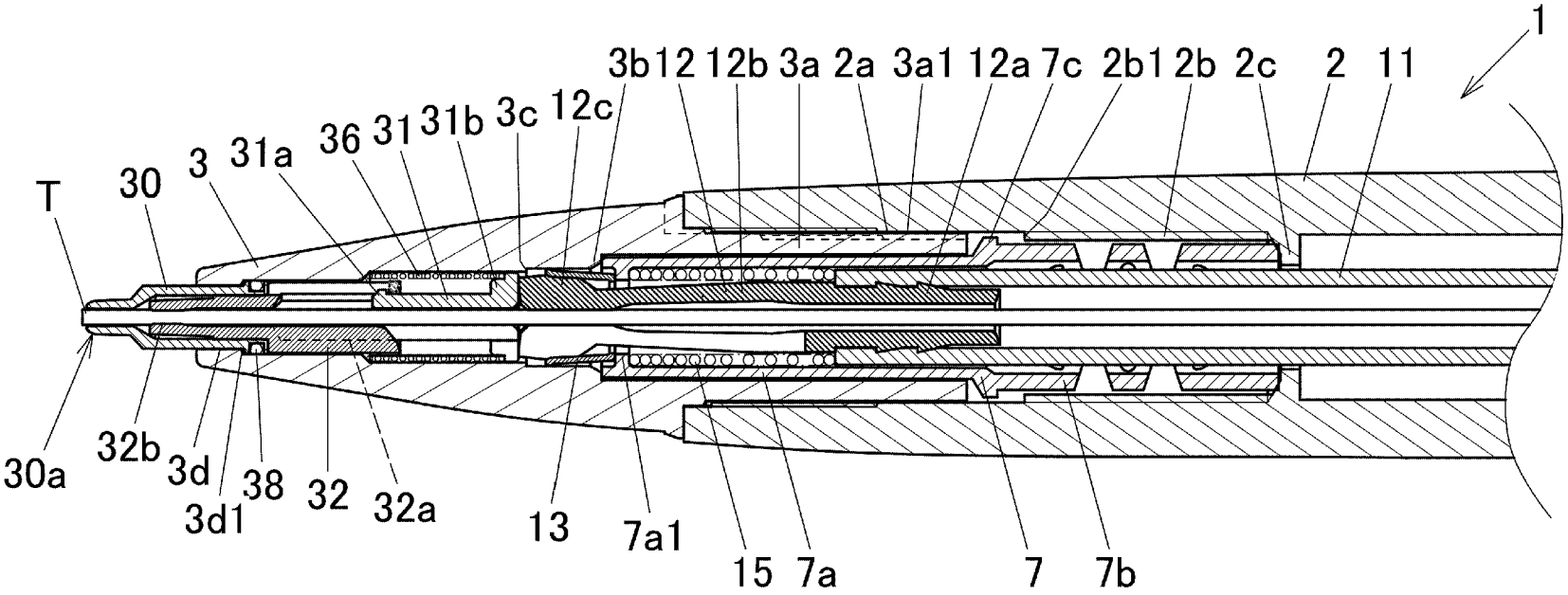
FIG. 4A is a partial sectional view of the forward side for explaining operations of the cushion spring performed when writing is continued by the mechanical pencil according to an embodiment, the partial sectional view illustrating an initial state.
Figure 4B:
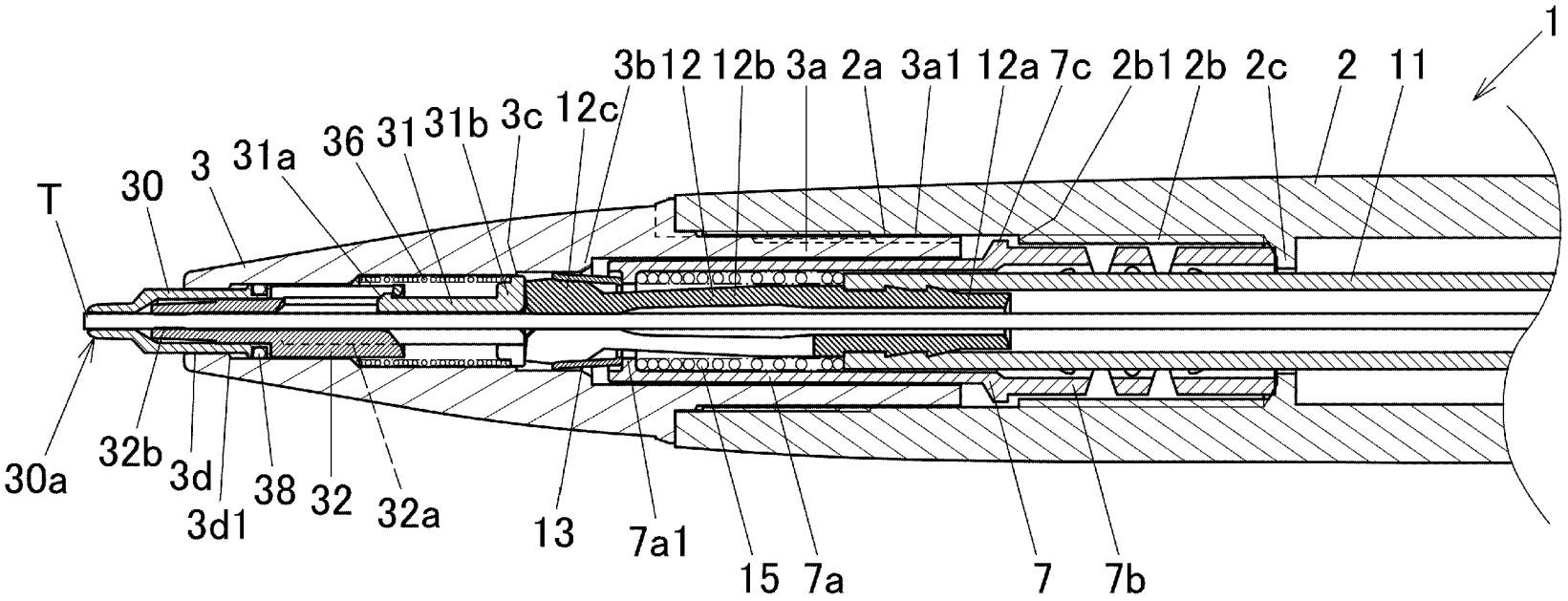
FIG. 4B is a partial sectional view of the forward side for explaining the operations of the cushion spring performed when writing is continued by the mechanical pencil according to an embodiment, the partial sectional view illustrating a state in which the cushion spring is bent.

Continuously writing with the mechanical pencil 1 consumes and wears out the writing lead T protruding from the tip of the tip tube 30, as illustrated in FIG. 4A. At this moment, the contact part 30*a* at the tip of the tip tube 30 comes into contact with the paper surface. As a result, the writing lead T receives a force directed axially rearward (i.e., writing pressure) from the paper surface, along with the tip tube 30 and the writing lead holder 32. Once the tip tube 30 and the writing lead holder 32 receive the writing pressure, the tip tube 30 and the writing lead holder 32 retract against the resistance force that occurs between the O-ring 38 of the tip tube 30 and the inner circumferential surface of the tip fitting 3. At this moment, since the guide tube 31 is biased rearward by the return spring 36, the guide tube 31 moves rearward together with the tip tube 30 and the writing lead holder 32. At the same time, once the writing lead T receives the writing pressure, the spring part 7*b* of the cushion member 7 bends and the chuck unit moves rearward. In other words, when the writing lead T receives the writing pressure, the chuck 12, the chuck ring 13, the sleeve part 7*a* of the cushion member 7, the chuck spring 15, and the writing lead tube 11 move rearward. FIG. 4B illustrates a state in which the writing lead T, together with the tip tube 30 and the writing lead holder 32, receives the writing pressure and the tip tube 30, the writing lead holder 32, and the chuck unit move rearward.

Figure 4C:
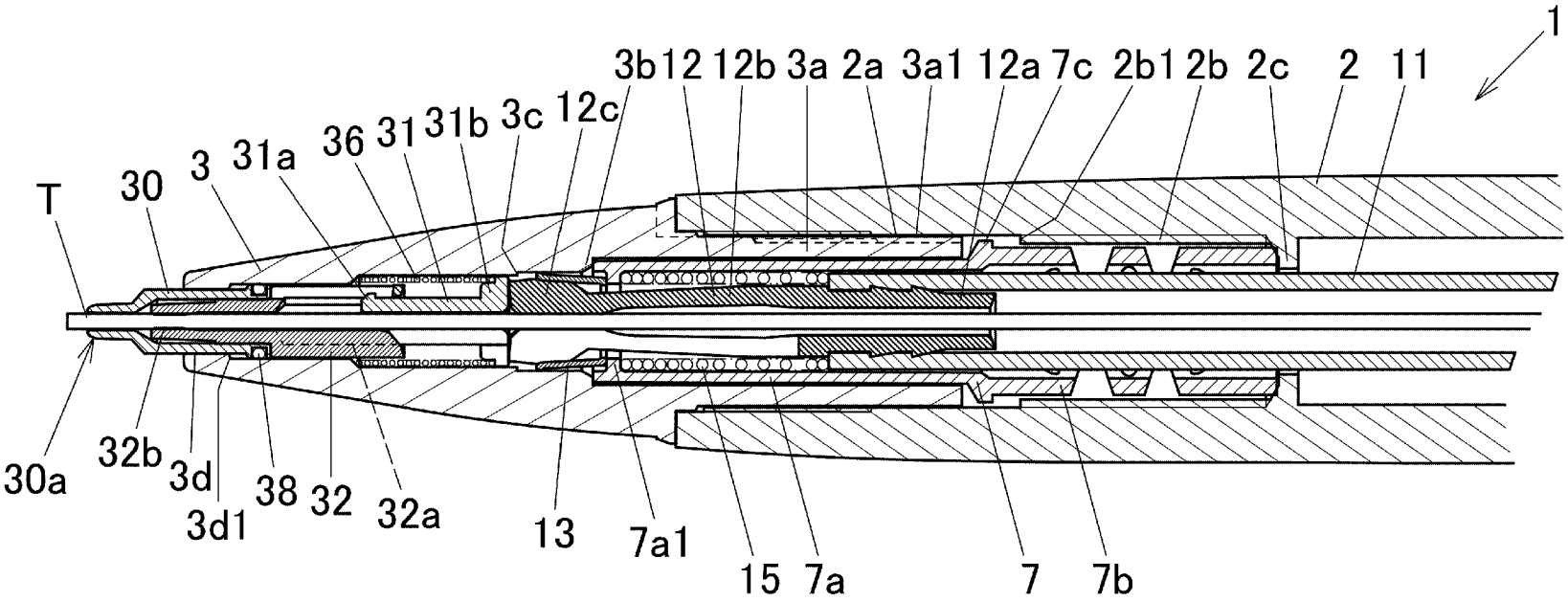
FIG. 4C is a partial sectional view of the forward side for explaining the operations of the cushion spring performed when writing is continued by the mechanical pencil according to an embodiment, the partial sectional view illustrating a state in which the cushion spring is restored.

Once the contact part 30*a* of the tip at the tip tube 30 separates from the paper surface, the spring part 7*b* of the cushion member 7 is restored by the elasticity thereof, moving the chuck unit forward and returns the chuck unit to the original position thereof. Specifically, as illustrated in FIG. 4C, the tip of the sleeve part 7*a* of the cushion member 7 once again comes into abutment with the stepped part 3*b* on the inner circumferential surface of the tip fitting 3, whereby the chuck 12, the chuck ring 13, the sleeve part 7*a* of the cushion member 7, the chuck spring 15, and the writing lead tube 11 return to the positions same as those illustrated in FIG. 4A. The tip tube 30 and the writing lead holder 32, on the other hand, remain at the position illustrated in FIG. 4B to which the tip tube 30 and the writing lead holder 32 have retracted in response to the writing pressure illustrated in FIG. 4B. When the spring part 7*b* of the cushion member 7 is restored as described above, the output of the spring part 7*b* of the cushion member 7 (i.e., a restoring force due to the elasticity) is greater than the force of the writing lead holder 32 holding the writing lead T, and the resistance force of the tip tube 30 against the tip fitting 3 is greater than the force of the writing lead holder 32 holding the writing lead T. According to this configuration, the writing lead T can be caused to protrude from the tip of the tip tube 30 without performing the click operation of the mechanical pencil 1. Therefore, the mechanical pencil 1 in which the writable distance obtained by a single click operation is longer than that of the prior art can be obtained. In order to cause the writing lead T to protrude from the tip of the tip tube 30 within a short cushion stroke without performing the click operation as described above, it is desirable to have the configuration in which the slope of the spring constant increases together with (according to) the cushion stroke, as in the spring part 7*b* of the cushion member 7 of the present embodiment.

In writing characters and the like using the mechanical pencil 1, the tip of the mechanical pencil 1 (e.g., the writing lead T or the tip tube 30) repeatedly comes into contact with and separates from the paper surface. In the present embodiment, the tip tube 30 and the chuck unit retract under a load sufficiently smaller than the writing pressure, and the chuck unit holding the writing lead T returns forward while leaving the tip tube 30 at the retracted position thereof when the writing lead T and the tip tube 30 separate from the paper surface. Therefore, writing can be continued using a prescribed length of the writing lead T without performing the click operation of feeding out the writing lead T of the mechanical pencil 1. The prescribed length of the writing lead T available for writing continuously is the length of the writing lead T corresponding to the length from a protrusion limit of the tip tube 30 (i.e., the position where the flange portion of the tip tube 30 abuts with the stepped part 3*d*1 of the tip fitting 3) to an indentation limit of the tip tube 30 (i.e., the position in the tip fitting 3 where the tip of the tip tube 30 is approximately flush with the tip of the tip fitting 3, into which the tip tube 30 is indented).

It is preferred that the set load of the spring part 7*b* of the cushion member 7 be set to be equal to or lower than the resistance force generated by the tip tube 30 retracting in the axial direction, so that the writing lead T and the chuck unit holding the writing lead T can retract together with the tip tube 30 retracting. As described above, the spring part 7*b* is configured in such a manner that an output thereof in response to a cushion stroke is non-linear as illustrated in FIG. 3, wherein the slope of the spring constant is small in a region where the cushion stroke is relatively small. In the present embodiment, favorable operations are performed as illustrated in FIGS. 4A to 4C in which, without being aware of the operation of the spring part 7*b* of the cushion member 7, the writing lead T is caused to naturally retract together with the tip tube 30 during writing so that the writing lead T is exposed from the tip tube 30. Furthermore, since the slope of the spring constant is large in the region where the cushion stroke is relatively large, the cushioning effect obtained due to the writing pressure of the spring part 7*b* of the cushion member 7 can be experienced within a relatively short cushion stroke range. In this case, the writing pressure can be reduced appropriately before the writing lead T is bent/broken.

In the present embodiment, the region where the cushion stroke is relatively small may be defined as, as described above, the first half of the diagram illustrated in FIG. 3 where the cushion stroke x (mm) is 0 to less than 0.4 mm but is more preferably the front portion of the diagram where the cushion stroke x (mm) is 0 to less than 0.2 mm, as long as the abovementioned effect is exerted. Most preferably, the region may indicate the front end portion in the diagram where the cushion stroke is 0 mm or the initial movement portion of the cushion spring (e.g., the spring part 7*b*). Similarly, in the present embodiment, the region where the cushion stroke is relatively large may be defined as, as described above, the latter half of the diagram illustrated in FIG. 3 where the cushion stroke x (mm) is equal to or greater than 0.4 mm, but is more preferably the latter portion of the diagram where the cushion stroke is 0.6 mm or more, as long as the abovementioned effect is exerted. Most preferably, the region may indicate the rear end portion of the diagram where the cushion stroke is 0.8 mm or the final movement portion of the cushion spring (e.g., the spring part 7*b*). For example, the slope of the spring constant of the cushion spring (e.g., the spring part 7*b*) at the initial movement portion can be set to be smaller than the slope of the spring constant at the final movement portion. Alternatively, in another embodiment, the cushion spring may be configured in such a manner that, in accordance with the average value of the slope of the spring constant in any region defined as above, the average value of the slope of the spring constant in the region where the cushion stroke is relatively small and is smaller than the average value of the slope of the spring constant in the region where the cushion stroke is relatively large. In this case, a preferable mechanical pencil can be configured using various cushion springs, including the use of a cushion spring that includes a region portion where the slope of the spring constant decreases arbitrarily as the cushion stroke increases.

Modifications of the spring part 7*b* (e.g., the cushion member 7) that are the cushion springs according to the other embodiments are described next.

(Modification 1)

Figure 5:
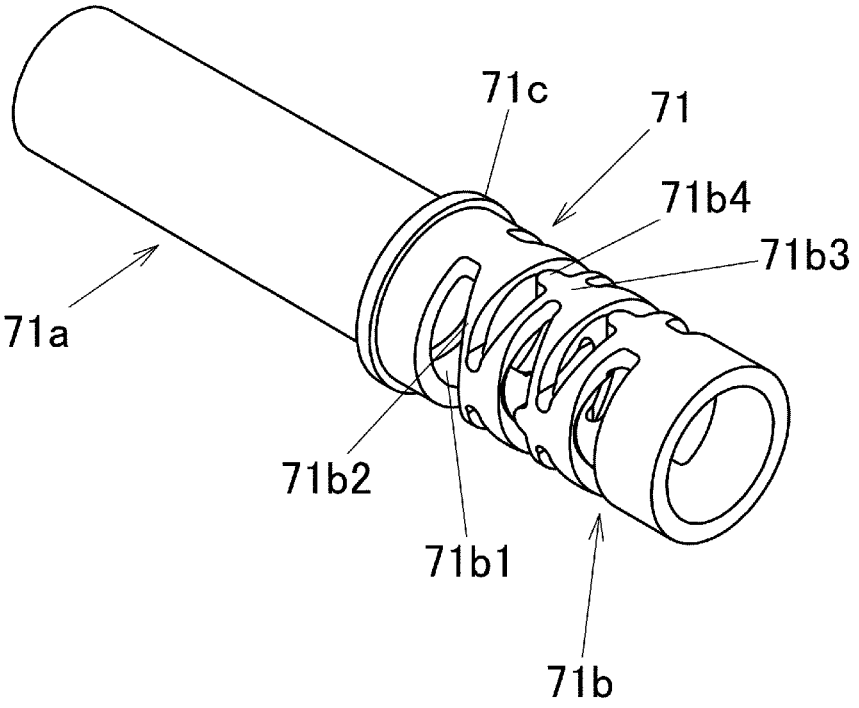
FIG. 5 is a perspective view illustrating modification 1 of the cushion spring of the mechanical pencil according to the embodiments.

FIG. 5 illustrates a cushion member 71 of modification 1. As with the cushion member 7 according to the embodiment illustrated in FIG. 2, the cushion member 71 of modification 1 has a sleeve part 71*a*, a spring part 71*b* functioning as the cushion spring, and a flange part 71*c*. A pair of elongated holes 71*b*1, a beam-like elastic part 71*b*2, and an inter-hole strut 71*b*3 are formed in the spring part 71*b*. In this modification 1 as well, the beam-like elastic part 71*b*2, which is in the shape of a tapered cantilever beam on a cylindrical surface, is formed in such a manner that an output of the spring part 71*b* functioning as the cushion spring is a non-linear output. The spring part 71*b* of the cushion member 71 of modification 1 further includes a plurality of restricting protrusions 71*b*4 protruding from an inter-hole strut 71*b*3 toward the inter-hole strut 71*b*3 that is adjacent thereto via the elongated hole 71*b*1 located forward in the axial direction. The restricting protrusions 71*b*4 are arranged in such a manner that the restricting protrusions 71*b*4 adjacent to each other along the axial direction are in a relative position rotated 90 degrees circumferentially about the axis.

According to the spring part 71*b* of the cushion member 7 of modification 1, even if the spring part 71*b* is compressed and thereby the elongated holes 71*b*1 shrink in the axial direction, each restricting protrusion 71*b*4 abuts with a portion facing a tip of said restricting protrusion 71*b*4 (e.g., the portion being each inter-hole strut 71*b*3 in modification 1), preventing the contraction of the elongated holes 71*b*1 from tightly attaching/solidly closing together the beam-like elastic portions 71*b*2 axially adjacent to each other. In this manner, by forming the restricting protrusions 71*b*4 as protrusions extending in the axial direction of the spring part 71*b* functioning as the cushion spring, a deterioration in performance of the spring part 71*b* caused by an excessive cushion operation such as the tight attachment/full-close of the spring (i.e., attachment/solidly close between the beam-like elastic parts 71*b*2) can be prevented.

Using the cushion member 71 of modification 1 can omit regulation of the compression of the spring part 7*b* caused by the abutment between the stepped part 2*b*1 on the inner circumferential surface of the barrel body 2 of the present embodiment and the flange part 7*c* of the cushion member 7 illustrated in FIG. 1, thereby simplifying the mechanism.

(Modification 2)

Figure 6:
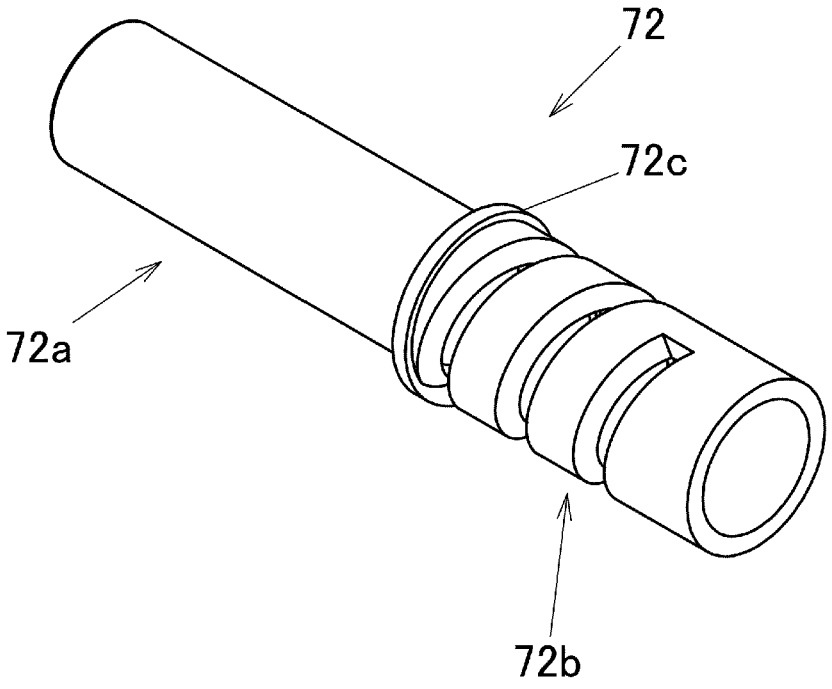
FIG. 6 is a perspective view illustrating modification 2 of the cushion spring of the mechanical pencil according to the embodiments.

FIG. 6 illustrates a cushion member 72 of modification 2. The cushion member 72 of modification 2 is a modification of the spring part 7*b* of the cushion member 7 of the present embodiment illustrated in FIG. 2. The cushion member 72 of modification 2 includes an approximately cylindrical sleeve part 72*a*, a spring part 72*b* functioning as the cushion spring, and a flange part 72*c*. The spring part 72*b* of modification 2 is a resin spring formed in a spiral shape and generates an axial elastic force. A cushion member having an excellent design, such as the cushion member 72 of modification 2, may be used as long as the output of the spring part functioning as the cushion spring is a non-linear output, as described above. In this case as well, any shape of the spring part that is thick in the radial direction may be changed arbitrarily so that the output of the spring part is a non-linear output.

(Modification 3)

Figure 7:
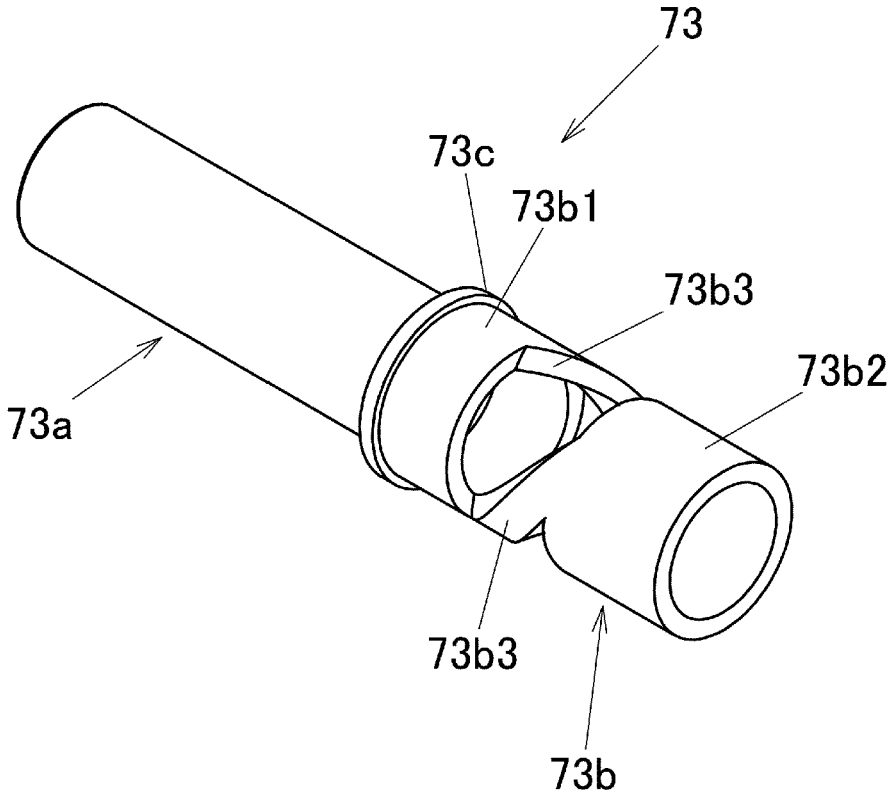
FIG. 7 is a perspective view illustrating modification 3 of the cushion spring of the mechanical pencil according to the embodiments.

FIG. 7 illustrates a cushion member 73 of modification 3. The cushion member 73 of modification 3 is a modification of the spring part 7*b* of the cushion member 7 of the present embodiment illustrated in FIG. 2. The cushion member 73 of modification 3 includes an approximately cylindrical sleeve part 73*a*, a spring part 73*b* functioning as the cushion spring, and a flange part 73*c*.

The spring part 73*b* has a front-side cylindrical part 73*b*1 and a rear-side cylindrical part 73*b*2. Two torsion springs 73*b*3 connecting the front-side cylindrical part 73*b*1 and the rear-side cylindrical part 73*b*2 are formed between the front-side cylindrical part 73*b*1 and the rear-side cylindrical part 73*b*2 in such a manner as to extend in a direction oblique to the axial direction. When a compressive force is applied to the cushion member 73 in the axial direction, the front-side cylindrical part 73*b*1 and the rear-side cylindrical part 73*b*2 rotate relatively in opposite directions in the circumferential direction around the axis, and the torsion springs 73*b*3 are compressed along the axial direction so as to be twisted, thereby generating an elastic force.

Embodiments and modifications of the present invention have been described above. However, the present invention can be implemented in various modes without being limited to the embodiments and modifications described above. For example, in the embodiments, although the sleeve and the cushion spring are formed integrally of a resin material, the sleeve part 7*a* and the spring part 7*b* may be formed separately. In so doing, the cushion spring can be formed into various elastic members such as a metal coil spring.

REFERENCE SIGNS LIST

1 Mechanical pencil
2 Barrel body
2*a* Internal screw part
2*b* Rib
2*b*1 Stepped part
2*c* Protruding part
3 Tip fitting
3*a* Cylindrical part
3*a*1 External screw part
3*b* Stepped part
3*c* Stepped part
3*d* Opening part
3*d*1 Stepped part
4 Eraser ferrule
4*a* Small diameter part

4*b* Large diameter part
5 Click button
6 Eraser
7 Cushion member
7*a* Sleeve part
7*a*1 Annular wall
7*b* Spring part
7*b*1 Elongated hole
7*b*2 Elastic beam-like part
7*b*3 Inter-hole strut
7*c* Flange part
11 Writing lead tube
12 Chuck
12*a* Base part
12*b* Beam-like part
12*c* Bulging part
13 Chuck ring
15 Chuck spring
30 Tip
30*a* Contact part
31 Guide tube
31*a* Forward protruding part
31*b* Base end part
32 Writing lead holder
32*a* Slit
32*b* Holding part
36 Return spring
38 O-ring
71 Cushion member
71*a* Sleeve part
71*b* Spring part
71*b*1 Elongated hole
71*b*2 Beam-like elastic part
71*b*3 Inter-hole strut
71*b*4 Restricting protrusion
71*c* Flange part
72 Cushion member
72*a* Sleeve part
72*b* Spring part
72*c* Flange part
73 Cushion member
73*a* Sleeve part
73*b* Spring part
73*b*1 Front-side cylindrical part
73*b*2 Rear-side cylindrical part
73*b*3 Spring
73*c* Flange part

What is claimed is:

1. A mechanical pencil, including:
a writing lead;
a chuck unit for chucking the writing lead;
a cushion spring configured to elastically support the chuck unit in such a manner that the chuck unit is retractable with a writing pressure; and
a tip supporting the writing lead from an outer diameter direction and capable of moving in an axial direction,
wherein an output of the cushion spring, in response to a cushion stroke, is non-linear, and a slope of a spring constant, in a region where the cushion stroke is relatively small, is smaller than a slope of a spring constant in a region where the cushion stroke is relatively large,
a set load the cushion spring is equal to or lower than a sliding, resistance force resulting from the tip retracting in the axial direction, and
a holding force of the tip holding the writing lead is set to be lower than the sliding resistance force of the tip.

2. The mechanical pencil according to claim 1, wherein the slope of the spring constant monotonically increases at a constant rate as the cushion stroke increases.

3. The mechanical pencil according to claim 1, wherein the cushion stroke of the cushion spring is limited within a range of a prescribed stroke length in which the writing lead is not broken by a writing pressure when the writing lead protrudes a same length as the cushion stroke, from a tip of a tip tube.

4. The mechanical pencil according to claim 1, wherein the cushion spring includes a resin material, and the cushion stroke of the cushion spring is limited within a range of a prescribed stroke length in which performance of the cushion spring is not deteriorated by compression thereof.

5. The mechanical pencil according to claim 1, wherein a contact part of the tip obtained when the tip comes into contact with a paper surface is rounded to form a roundedly chamfered edge.

6. The mechanical pencil according to claim 1, wherein the slope of the spring constant of the cushion spring at an initial movement portion is smaller than the slope of the spring constant at a final movement portion.

7. The mechanical pencil according to claim 1, wherein an average value of the slope of a spring constant of a plurality of regions where the cushion stroke is relatively small, is smaller than an average value of the slope of a spring constant of a plurality of regions where the cushion stroke is relatively large.

8. The mechanical pencil according to claim 1, wherein when a compressive force is applied to the cushion member in the axial direction, a front-side cylindrical part of the cushion spring and a rear-side cylindrical part of the cushion spring rotate relatively in opposite directions in a circumferential direction around an axis.

9. A mechanical pencil, including:
a writing lead;
a chuck unit for chucking the writing lead;
a cushion spring configured to elastically support the chuck unit in such a manner that the chuck unit is retractable with a writing pressure; and
a tip supporting the writing lead from an outer diameter direction and capable of moving in an axial direction,
wherein an output of the cushion spring, in response to a cushion stroke, is non-linear, and a slope of a spring constant, in a region where the cushion stroke is relatively small, is smaller than a slope of a spring constant in a region where the cushion stroke is relatively large; and
wherein, when the cushion spring is restored to an original position, the output of the cushion spring is greater than a holding force of the tip holding the writing lead, and a sliding resistance force of the tip is greater than the holding force of the tip holding the writing lead.

10. The mechanical pencil according to claim 9, wherein a contact part of the tip obtained when the tip comes into contact with a paper surface is rounded to form a roundedly chamfered edge.

* * * * *